US006338380B1

(12) United States Patent
O'Dwyer

(10) Patent No.: US 6,338,380 B1
(45) Date of Patent: Jan. 15, 2002

(54) MULTIPORT MOLD COOLING APPARATUS FOR CONTINUOUS CASTING

(76) Inventor: James P. O'Dwyer, 362-22560 Wye Road, Sherwood Park Alberta (CA), T8A-4T6

( * ) Notice: Subject to any disclaimer, the term of this patent is extended or adjusted under 35 U.S.C. 154(b) by 0 days.

(21) Appl. No.: 09/844,762

(22) Filed: Apr. 27, 2001

(51) Int. Cl.[7] ..... B22D 11/124
(52) U.S. Cl. ..... 164/443; 164/485; 164/414
(58) Field of Search ..... 164/443, 485, 164/414, 418

(56) References Cited

U.S. PATENT DOCUMENTS

| | | | | |
|---|---|---|---|---|
| 3,763,920 | A | 10/1973 | Auman et al. | 164/485 |
| 3,910,342 | A | 10/1975 | Johnson | 164/418 |
| 3,926,244 | A | 12/1975 | Meier et al. | 164/455 |
| 4,014,379 | A | 3/1977 | Getselev | 164/452 |
| 4,031,949 | A | 6/1977 | Colombo | 164/443 |
| 4,040,467 | A | 8/1977 | Alberny et al. | 164/468 |
| 4,088,179 | A | 5/1978 | Yabuki et al. | 164/441 |
| 4,088,295 | A | 5/1978 | Medovar et al. | 164/418 |
| 4,129,172 | A | 12/1978 | Snee, Jr. | 164/348 |
| 4,480,976 | A | 11/1984 | Vaubel et al. | 164/416 |
| 4,580,614 | A | 4/1986 | Haissig | 164/414 |
| 4,658,884 | A | 4/1987 | Euler et al. | 164/443 |
| D342,125 | S | 12/1993 | Miller | D23/323 |
| 5,289,869 | A | 3/1994 | Klein et al. | 165/273 |
| 5,762,127 | A | 6/1998 | Benedetti et al. | 164/485 |
| 6,158,946 | A * | 12/2000 | Lonardi et al. | 164/443 |
| 6,167,940 | B1 * | 1/2001 | Lonardi et al. | 164/443 |

* cited by examiner

*Primary Examiner*—Nam Nguyen
*Assistant Examiner*—I.-H. Lin

(57) ABSTRACT

A multiport mold cooling apparatus for eliminating or reducing rhomboid errors and materials cracking defects during the production process. The multiport mold cooling apparatus includes a support base assembly including a housing having side walls, an open top and bottom, and further having holes disposed through the side walls; and also includes a tubular mold support member being removably disposed in the housing and being adapted to removably receive a mold therein; and further includes a plurality of water blocker members being removably disposed in the housing and about the tubular mold support member; and also includes a restriction-free water flow assembly including a plurality of restriction-free water flow members being removably disposed in the housing and about the tubular mold support member; and further includes a water flow control assembly being mounted to the support base assembly.

9 Claims, 10 Drawing Sheets

MULTIPORT MOLD COOLING APPARATUS FOR CONTINUOUS CASTING

BACKGROUND OF THE INVENTION

1. Field of the Invention

The present invention relates to mold cooling apparatuses and more particularly pertains to a new multiport mold cooling apparatus for eliminating or reducing rhomboid errors and materials cracking defects during the continuous casting process. Rhomboidity is a measure of squareness defined as the difference between diagonal measurements of a square cross-section of continuous cast material.

2. Description of the Prior Art

The use of mold cooling apparatuses is known in the prior art. More specifically, mold cooling apparatuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,658,884; U.S. Pat. No. 4,088,179; U.S. Pat. No. 3,763,920; U.S. Pat. No. Des. 342,125; U.S. Pat. No. 4,040,467; U.S. Pat. No. 4,088,295; U.S. Pat. No. 4,129,172; U.S. Pat. No. 4,031,949; U.S. Pat. No. 4,480,976; U.S. Pat. No. 4,014,379; U.S. Pat. No. 3,926,244; U.S. Pat. No. 3,910,342; U.S. Pat. No. 4,580,614; U.S. Pat. No. 5,289,869; and U.S. Pat. No. 5,762,127.

While these devices fulfill their respective, particular objectives and requirements, the aforementioned patents do not disclose a new multiport mold cooling apparatus. The inventive device includes a support base assembly including a housing having side walls, an open top and bottom, and further having holes disposed through the side walls; and also includes a tubular mold support member being removably disposed in the housing and being adapted to removably receive a mold therein; and further includes a plurality of water blocker members being removably disposed in the housing and about the tubular mold support member; and also includes a restriction-free water flow assembly including a plurality of restriction-free water flow members being removably disposed in the housing and about the tubular mold support member; and further includes a water flow control assembly being mounted to the support base assembly.

In these respects, the multiport mold cooling apparatus according to the present invention substantially departs from the conventional concepts and designs of the prior art, and in so doing provides an apparatus primarily developed for the purpose of eliminating or reducing rhomboid errors and materials cracking defects during the production process.

SUMMARY OF THE INVENTION

In view of the foregoing disadvantages inherent in the known types of mold cooling apparatuses now present in the prior art, the present invention provides a new multiport mold cooling apparatus construction wherein the same can be utilized for eliminating or reducing rhomboid errors and materials cracking defects during the production process.

The general purpose of the present invention, which will be described subsequently in greater detail, is to provide a new multiport mold cooling apparatus which has many of the advantages of the mold cooling apparatuses mentioned heretofore and many novel features that result in a new multiport mold cooling apparatus which is not anticipated, rendered obvious, suggested, or even implied by any of the prior art mold cooling apparatuses, either alone or in any combination thereof.

To attain this, the present invention generally comprises a support base assembly including a housing having side walls, an open top and bottom, and further having holes disposed through the side walls; and also includes a tubular mold support member being removably disposed in the housing and being adapted to removably receive a mold therein; and further includes a plurality of water blocker members being removably disposed in the housing and about the tubular mold support member; and also includes a restriction-free water flow assembly including a plurality of restriction-free water flow members being removably disposed in the housing and about the tubular mold support member; and further includes a water flow control assembly being mounted to the support base assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multiport mold cooling apparatus which has many of the advantages of the mold cooling apparatuses mentioned heretofore and many novel features that result in a new multiport mold cooling apparatus which is not anticipated, rendered obvious, suggested, or even implied by any of the prior art mold cooling apparatuses, either alone or in any combination thereof.

It is another object of the present invention to provide a new multiport mold cooling apparatus which may be easily and efficiently manufactured and marketed.

It is a further object of the present invention to provide a new multiport mold cooling apparatus which is of a durable and reliable construction.

An even further object of the present invention is to provide a new multiport mold cooling apparatus to industry which is susceptible of a low cost of manufacture with regard to both materials and labor.

Still yet another object of the present invention is to provide a new multiport mold cooling apparatus which provides in the apparatuses and methods of the prior art some of the advantages thereof, while simultaneously overcoming some of the disadvantages normally associated therewith.

Still another object of the present invention is to provide a new multiport mold cooling apparatus for eliminating or reducing rhomboid errors and materials cracking defects during the production process.

Yet another object of the present invention is to provide a new multiport mold cooling apparatus which includes a support base assembly including a housing having side walls, an open top and bottom, and further having holes disposed through the side walls; and also includes a tubular mold support member being removably disposed in the housing and being adapted to removably receive a mold therein; and further includes a plurality of water blocker members being removably disposed in the housing and about the tubular mold support member; and also includes a restriction-free water flow assembly including a plurality of restriction-free water flow members being removably disposed in the housing and about the tubular mold support member; and further includes a water flow control assembly being mounted to the support base assembly.

Still yet another object of the present invention is to provide a new multiport mold cooling apparatus that increases the water contact and heat transfer.

Even still another object of the present invention is to provide a new multiport mold cooling apparatus that evenly cools the mold more effectively.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
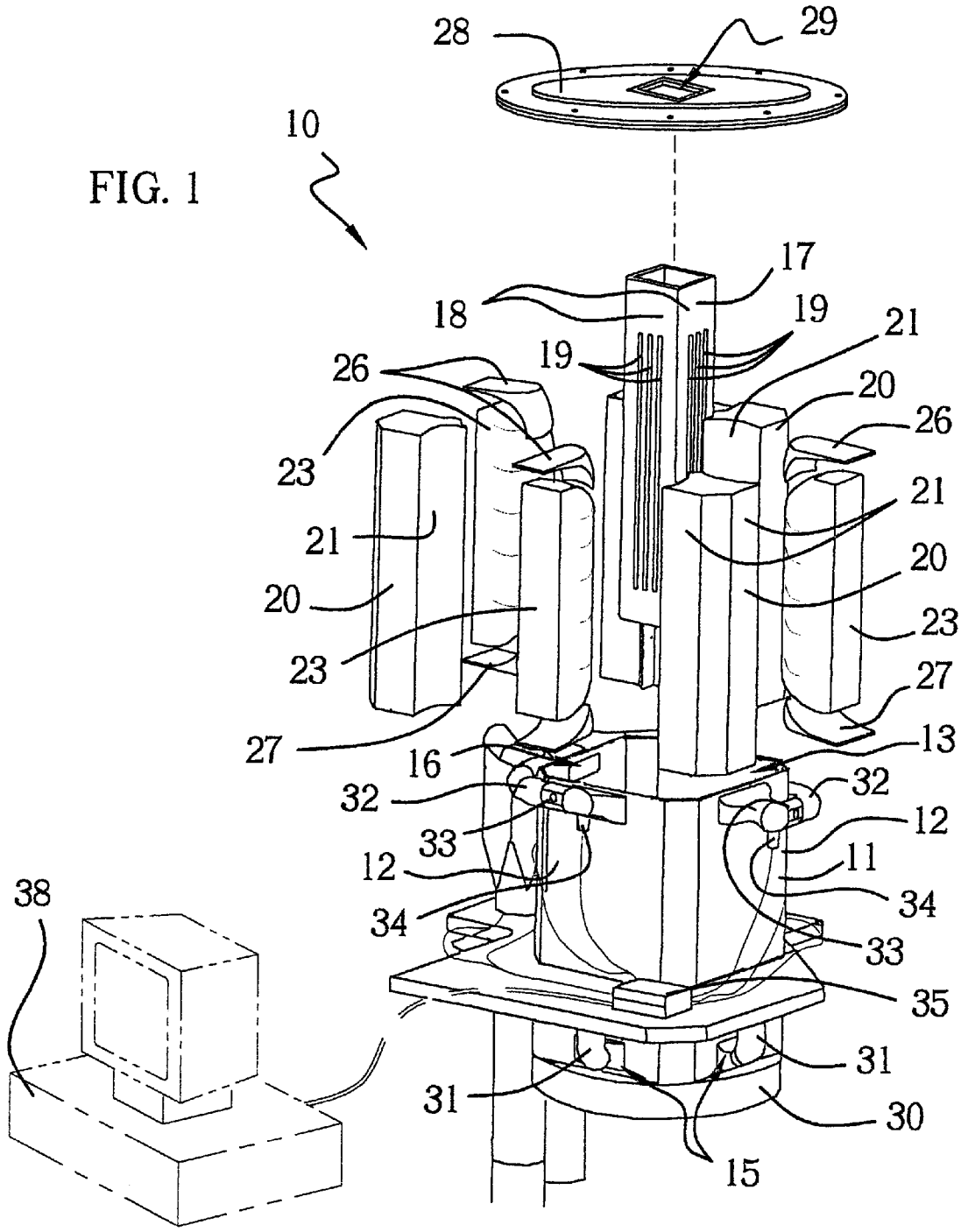
FIG. 1 is an exploded perspective view of a new multiport mold cooling apparatus according to the present invention.
Figure 2:
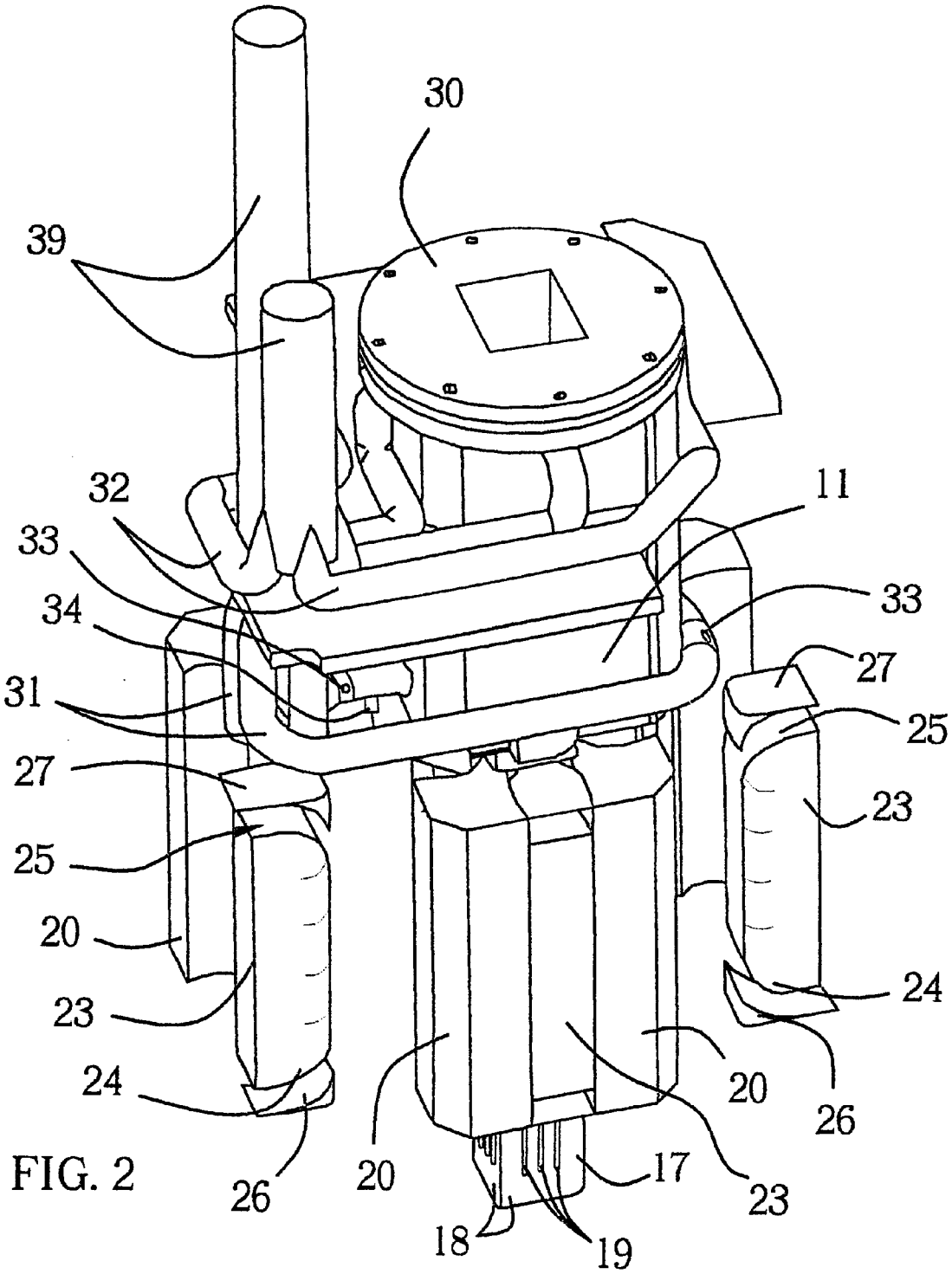
FIG. 2 is a perspective view of the present invention.
Figure 3:
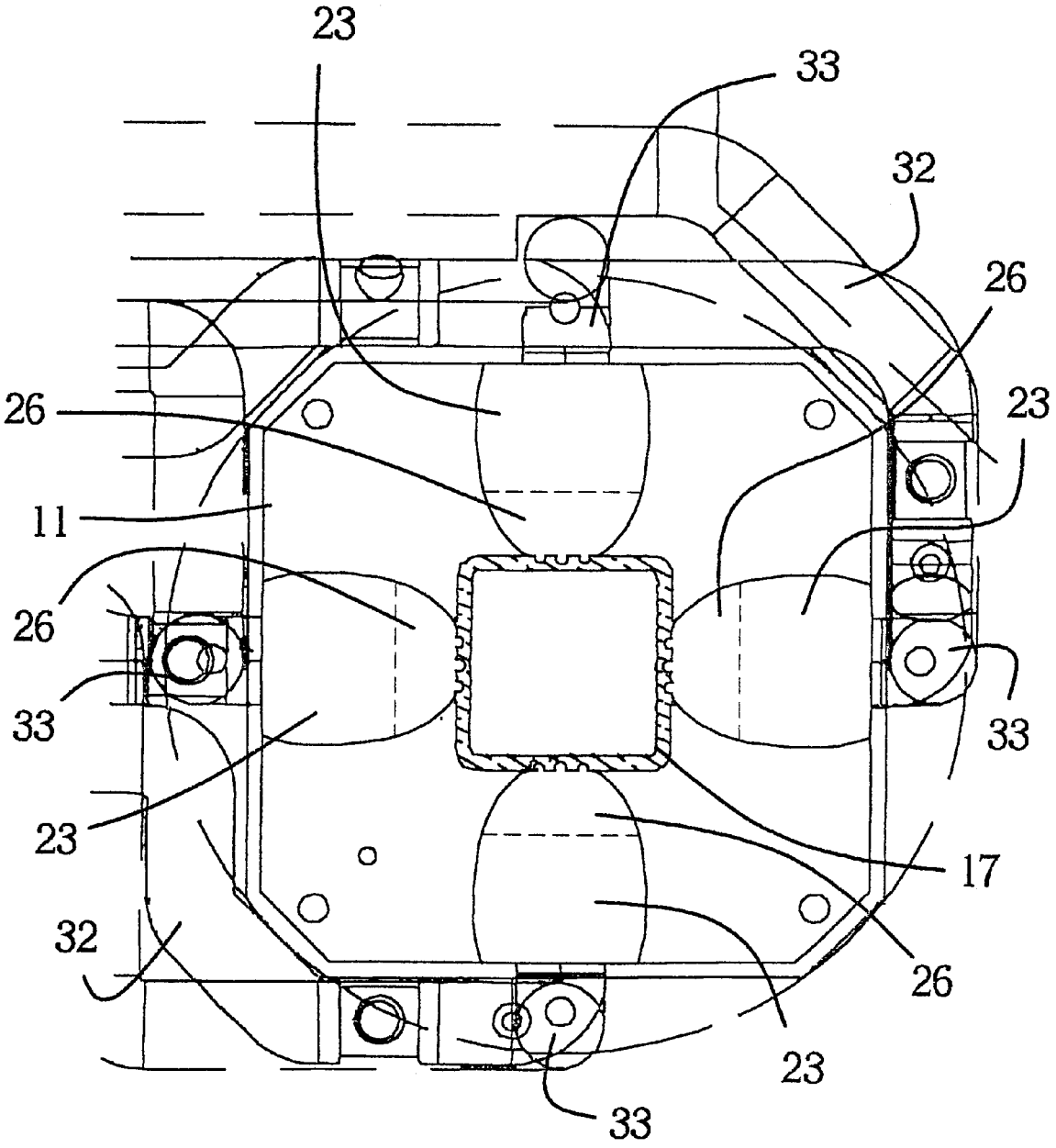
FIG. 3 is a top plan view of the present invention.
Figure 4:
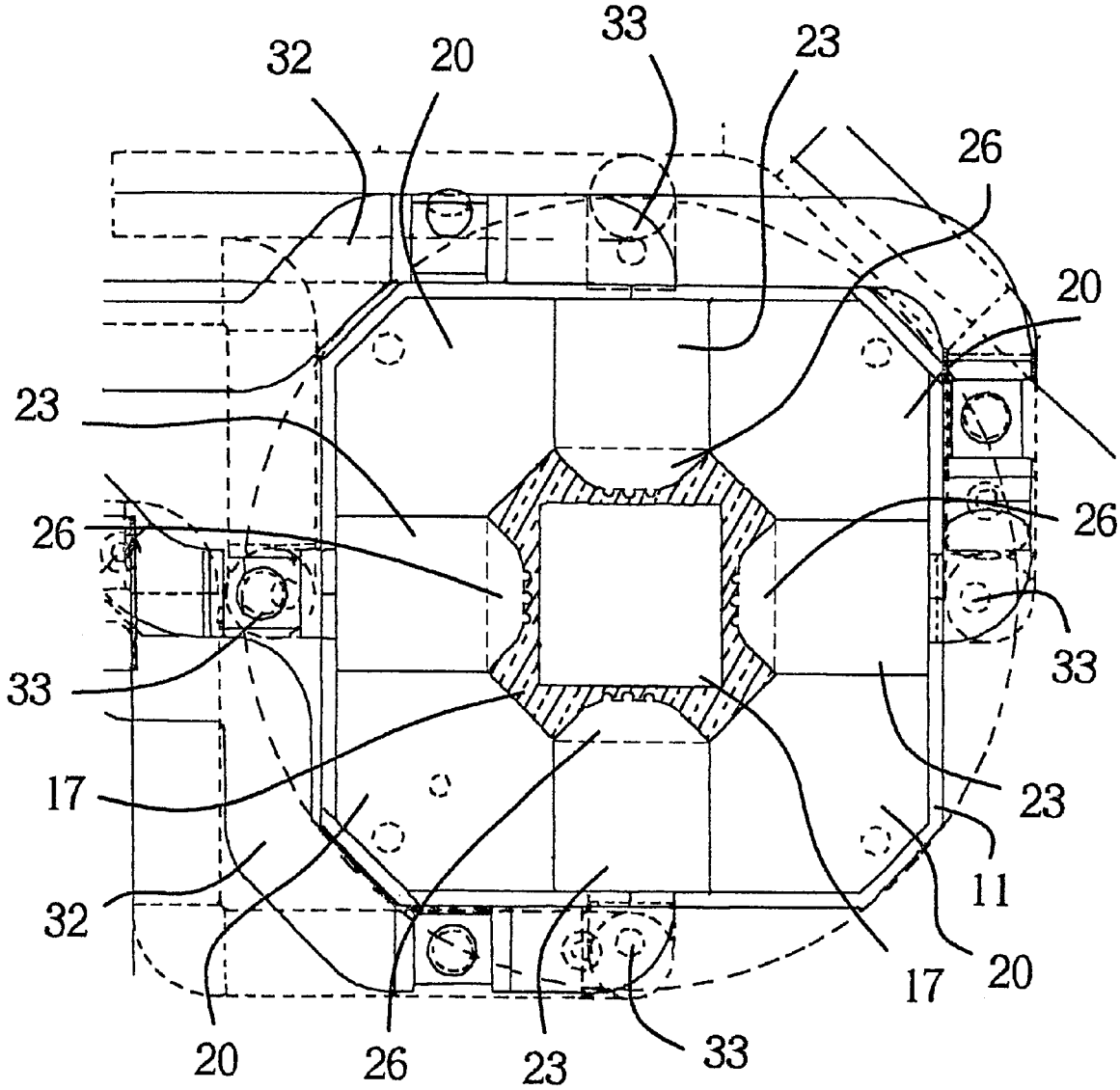
FIG. 4 is another top plan view of the present invention showing variations of the tubular mold support member and water blocker members.
Figure 5:
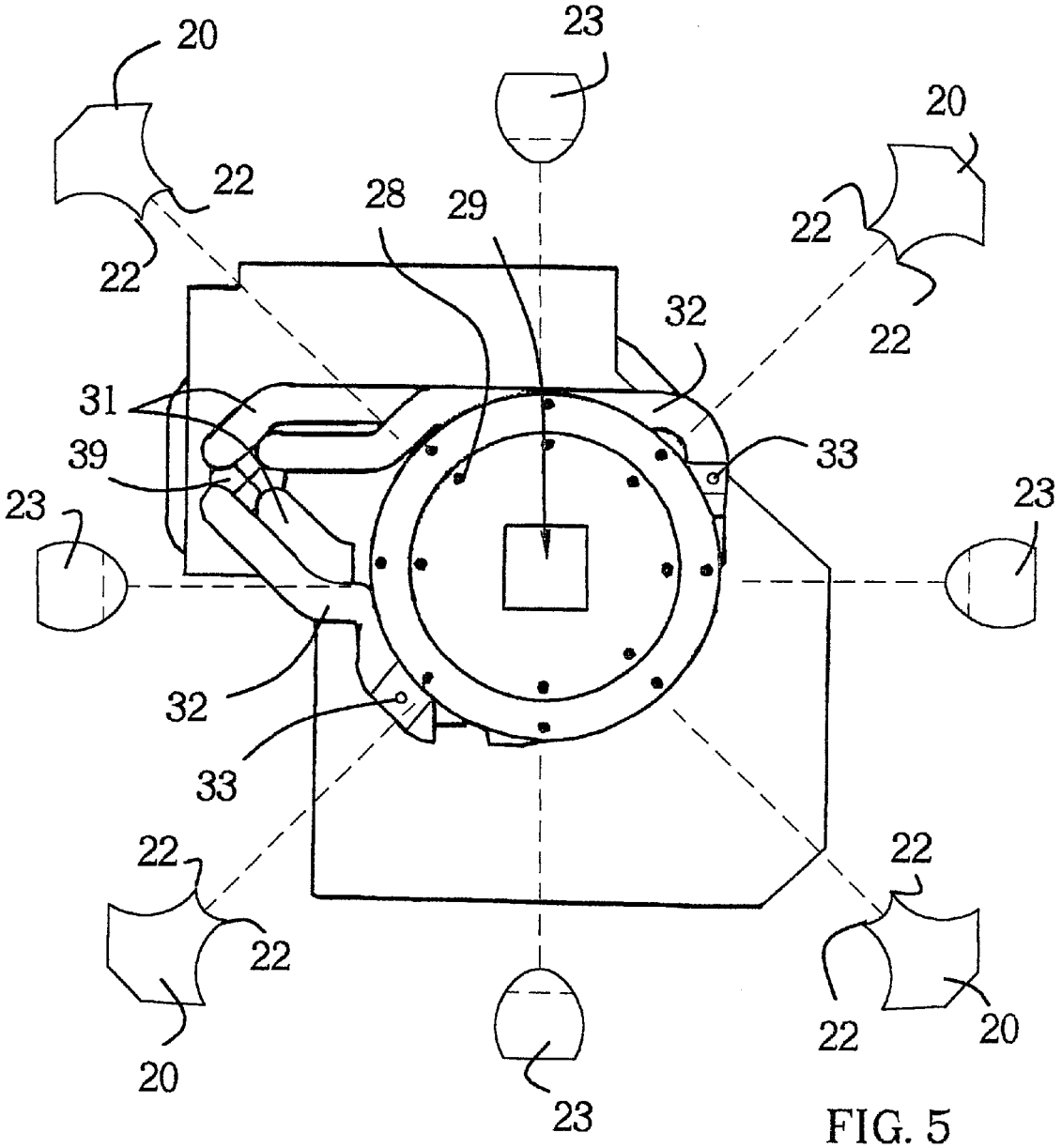
FIG. 5 is yet another top plan view of the present invention.
Figure 6:
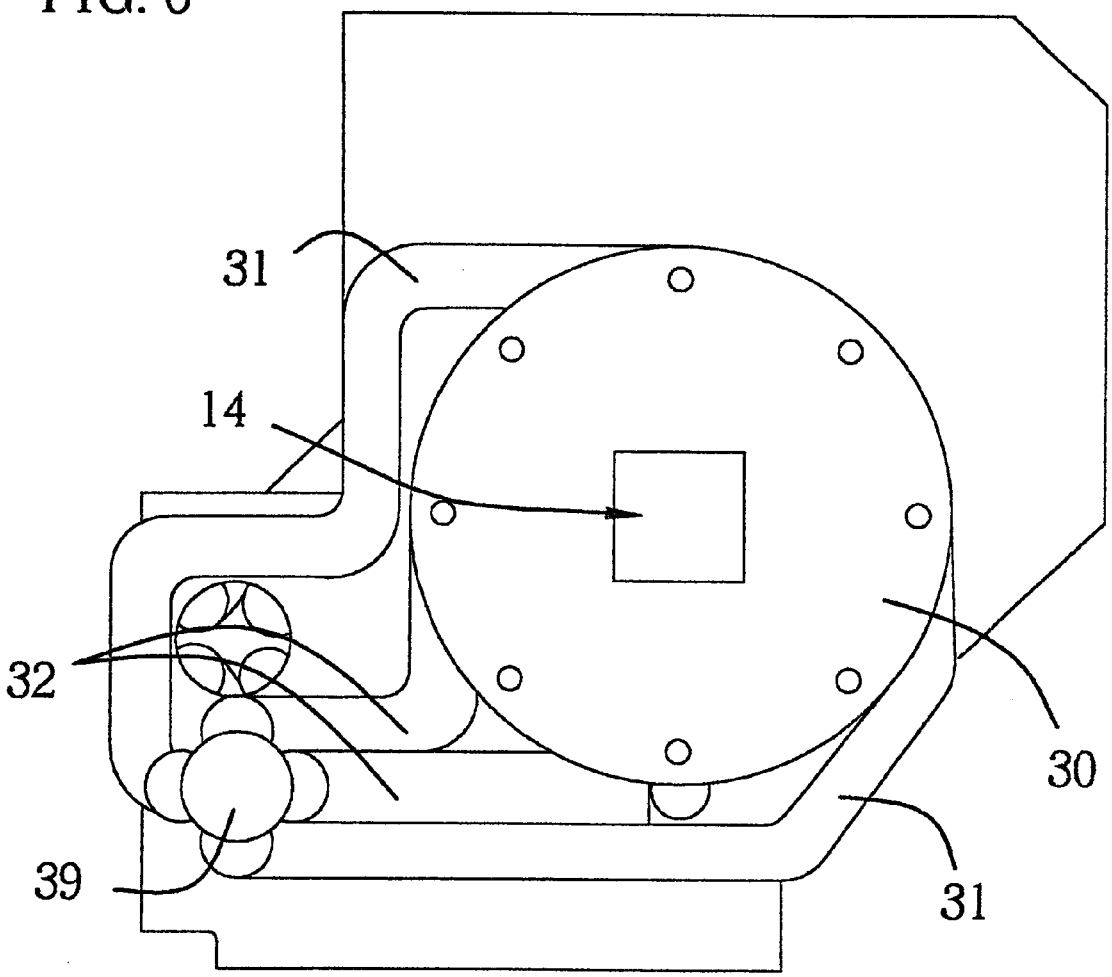
FIG. 6 is a bottom plan view of the present invention.
Figure 7:
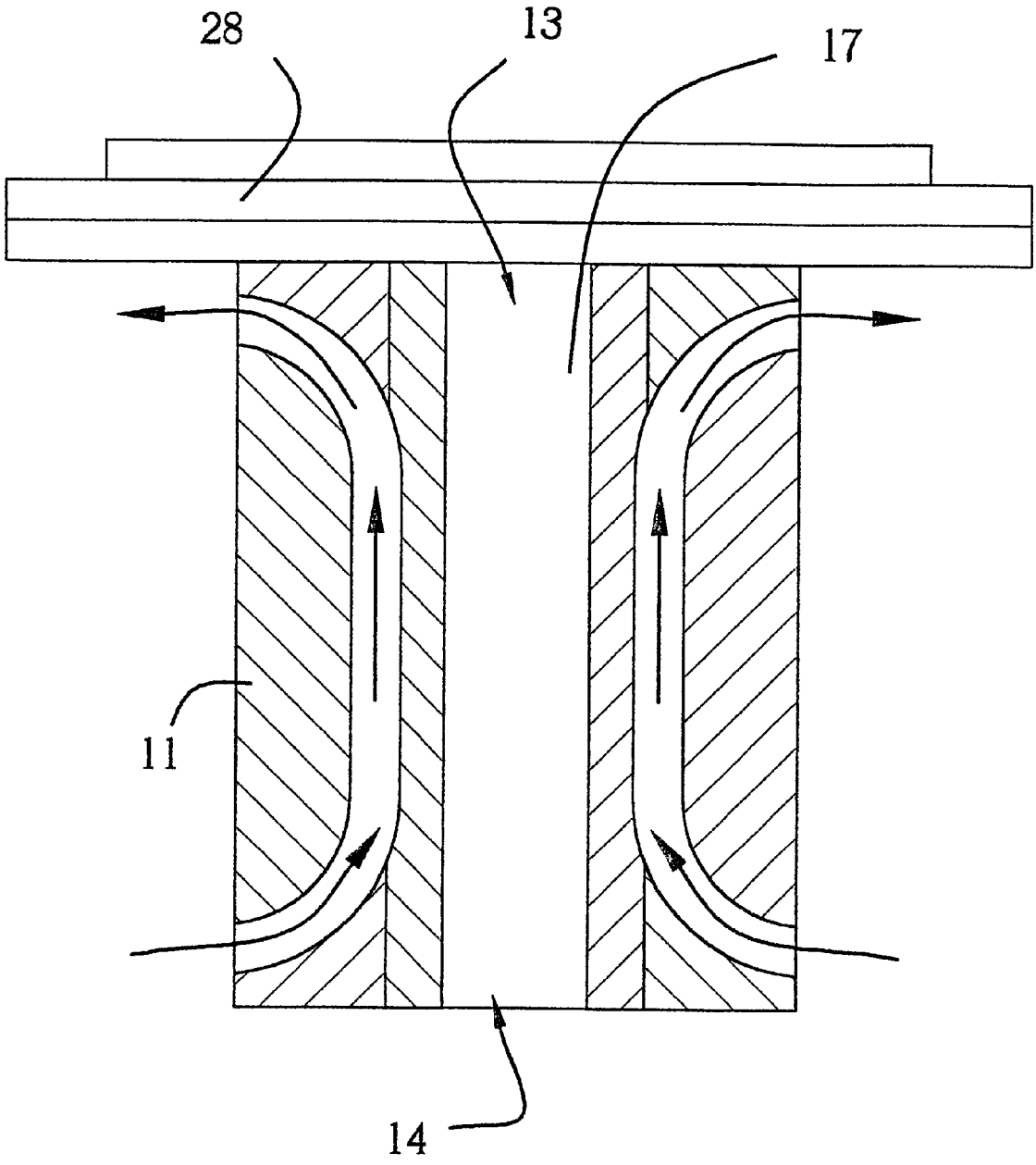
FIG. 7 is a cross-sectional view of the present invention.
Figure 8:
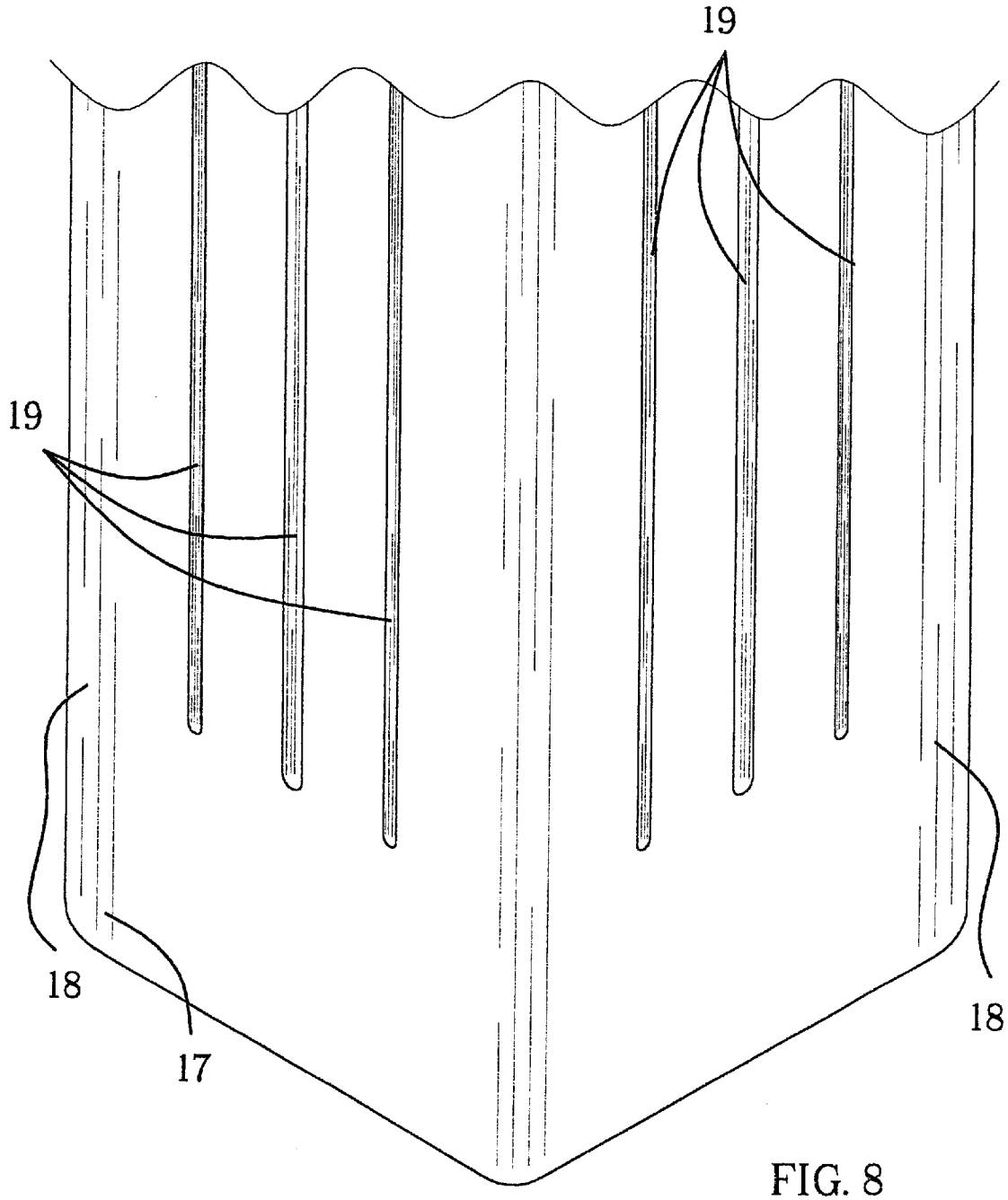
FIG. 8 is a partial perspective view of the tubular mold support member of the present invention.
Figure 9:
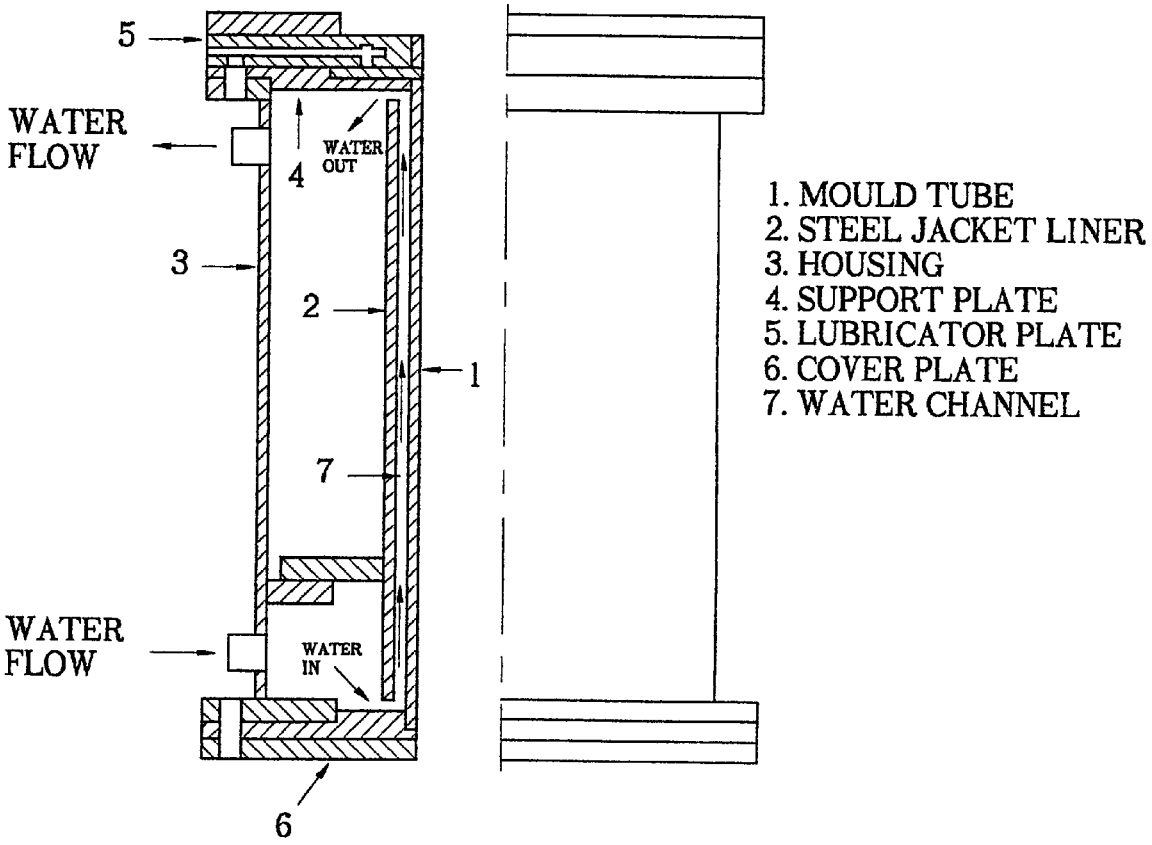
FIG. 9 (PRIOR ART)
FIG. 9 is a cross-sectional view of the prior art.
Figure 10:
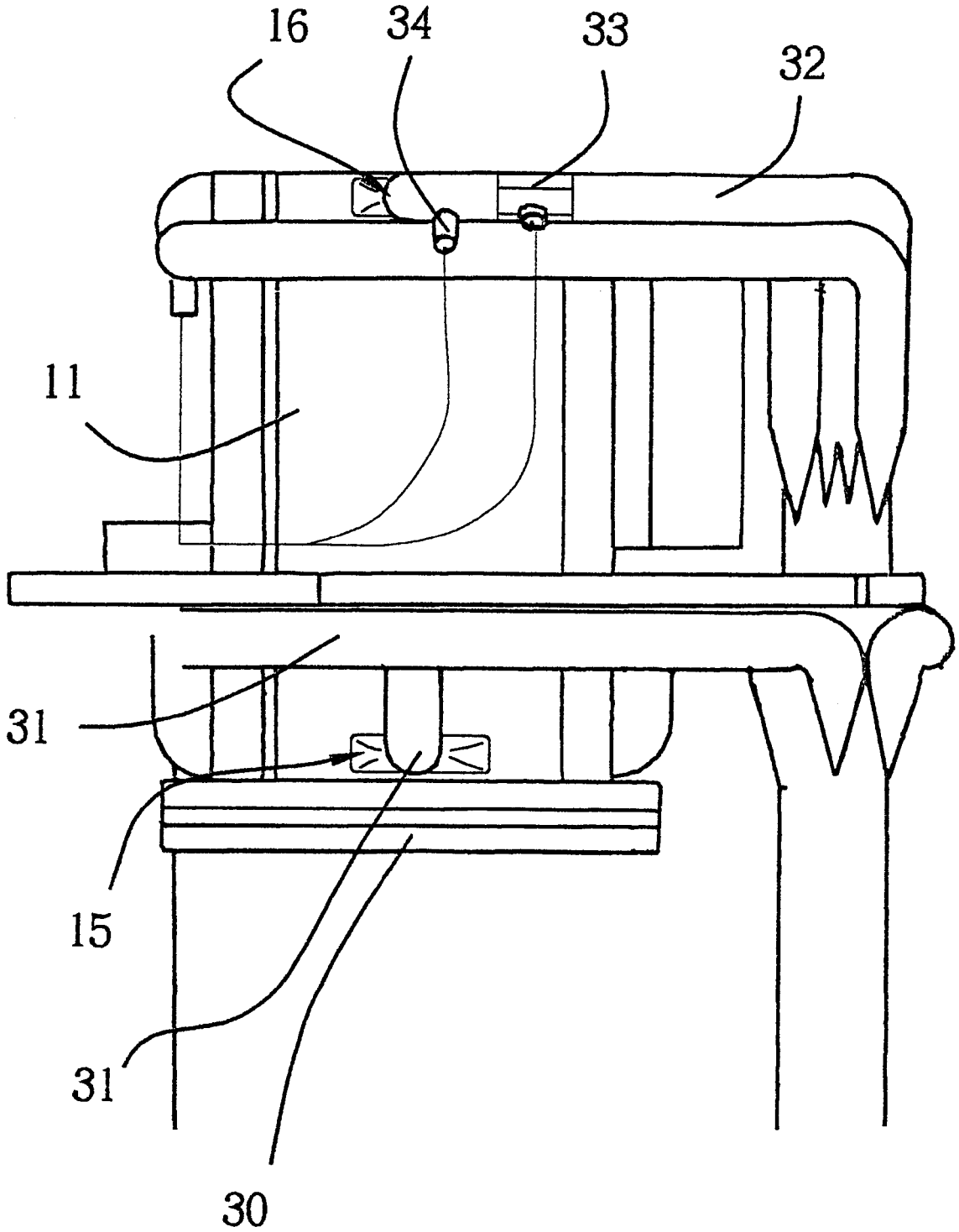
FIG. 10 is a side elevational view of the support base member of the present invention.

With reference now to the drawings, and in particular to FIGS. 1 through 10 thereof, a new multiport mold cooling apparatus embodying the principles and concepts of the present invention and generally designated by the reference numeral 10 will be described.

As best illustrated in FIGS. 1 through 10, the multiport mold cooling apparatus 10 generally comprises a support base assembly including a housing 11 having side walls 12, an open top 13 and bottom 14, and further having holes 15,16 being disposed through the side walls 12. The holes 15,16 in the housing 11 include inlet holes 15 being disposed through the side walls 12 near the open bottom 14, and also include outlet holes 16 being disposed through the side walls 12 near the open top 13. The support base assembly further includes a top cover 28 being removably disposed upon the open top 13 of the housing 11 and having an opening 29 centrally-disposed therethrough, and also includes a bottom cover 30 being removably disposed upon the open bottom 14 of the housing 11.

A tubular mold support member 17 is removably disposed in the housing 11 and is adapted to removably receive a mold. The tubular mold support member 17 has side walls 18 and a plurality of fluted grooves 19 being disposed in an exterior of the side walls 18. The tubular mold support member 17 is conventionally attached to the top cover 28. The fluted grooves 19 are semi-circular and extend the length of the tubular mold support member 17 with the depth of the fluted grooves 19 not exceeding ⅓ inch thickness of the tubular mold support member 17.

A plurality of water blocker members 20 being removably disposed in the housing 11 and about the tubular mold support member 17. Each of the water blocker members 20 is an elongate block being disposed about a respective corner of the tubular mold support member 17 and having longitudinal flanges 22 extending outwardly from side walls 21 and near a corner of the elongate block 20. The longitudinal flanges 22 are spaced apart with a respective corner of the tubular mold support member 17 being received therebetween to effectuate heat transfer from a mold being disposed in the tubular mold support member 17.

A restriction-free water flow assembly includes a plurality of restriction-free water flow members 23 being removably disposed in the housing 11 and about the tubular mold support member 17. Each of the restriction-free water flow members 23 is an elongate tubular member which has a top meniscus 24 and a bottom meniscus 25 and which is disposed upon a respective side wall 18 of the tubular mold support member 17. The restriction-free water flow assembly also includes a plurality of top cap swedges 26 being disposed upon the top meniscuses 24 and also includes a plurality of bottom cap swedges 27 being disposed upon the bottom meniscuses 25.

A water flow control assembly is conventionally mounted to the support base assembly. The water control assembly includes a plurality of inlet and outlet hose members 31,32 being conventionally attached to the inlet and outlet holes 15,16 respectively, and also includes a plurality of valve members 33 being conventionally disposed inline of the outlet hose members 32, and further includes a plurality of thermocouples 34 being conventionally attached to the outlet hose members 32, and also includes a computer link member 35 being conventionally attached to the support base assembly and to the valve members 33 and to the thermocouples 34. The computer link member 35 is adapted to be connected to a computer 38 for controlling operation of the valve members 33 and the thermocouples 34 to effect flow of water through the hose members 31,32. The inlet hose members 31 are adapted to be connected to a water source 39.

In use, the user places the tubular mold support member 17 in the housing 11, and uses a computer 38 to run water through the housing 11 and about all sides of the tubular mold support member 17 to effectively and evenly cool the mold inside the tubular mold support member.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multi-port mold cooling apparatus comprising:

a support base assembly including a housing having side walls, an open top and bottom, and further having holes disposed through said side walls;

a tubular mold support member being removably disposed in said housing and being adapted to removably receive a mold;

a plurality of water blocker members being removably disposed in said housing and about said tubular mold support member;

a restriction-free water flow assembly including a plurality of restriction-free water flow members being removably disposed in said housing and about said tubular mold support member; and a water flow control assembly being mounted to said support base assembly.

2. A multi-port mold cooling apparatus as described in claim 1, wherein said holes in said housing include inlet holes being disposed through said side walls near said open bottom, and also include outlet holes being disposed through said side walls near said open top.

3. A multi-port mold cooling apparatus as described in claim 2, wherein said support base assembly further includes a top cover being removably disposed upon said open top of said housing and having an opening centrally-disposed therethrough, and also includes a bottom cover being removably disposed upon said open bottom of said housing.

4. A multi-port mold cooling apparatus as described in claim 2, wherein said water control assembly includes a plurality of inlet and outlet hose members being attached to said inlet and outlet holes respectively, and also includes a plurality of valve members being disposed inline of said outlet hose members, and further includes a plurality of thermocouples being attached to said outlet hose members, and also includes a computer link member being attached to said support base assembly and to said valve members and to said thermocouples, said computer link member being adapted to be connected to a computer for controlling operation of said valve members and said thermocouples to effect flow of water through said hose members, said inlet hose members being adapted to be connected to a water source.

5. A multi-port mold cooling apparatus as described in claim 1, wherein said tubular mold support member has side walls and a plurality of fluted grooves disposed in an exterior of said side walls, said tubular mold support member being attached to said top cover.

6. A multi-port mold cooling apparatus as described in claim 5, wherein each of said water blocker members is an elongate block being disposed about a respective corner of said tubular mold support member and has longitudinal flanges extending outwardly from side walls and near a corner of said elongate block, said longitudinal flanges being spaced apart with a respective said corner of said tubular mold support member being received therebetween to effectuate heat transfer from a mold being disposed in said tubular mold support member.

7. A multi-port mold cooling apparatus as described in claim 5, wherein each of said restriction-free water flow members is an elongate tubular member which has a top meniscus and a bottom meniscus and which is disposed upon a respective said side wall of said tubular mold support member.

8. A multi-port mold cooling apparatus as described in claim 7, wherein said restriction-free water flow assembly includes a plurality of top cap swedges being disposed upon said top meniscuses and also includes a plurality of bottom cap swedges being disposed upon said bottom meniscuses.

9. A multi-port mold cooling apparatus comprising:

a support base assembly including a housing having side walls, an open top and bottom, and further having holes disposed through said side walls, said holes in said housing including inlet holes being disposed through said side walls near said open bottom, and also including outlet holes being disposed through said side walls near said open top, said support base assembly further including a top cover being removably disposed upon said open top of said housing and having an opening centrally-disposed therethrough, and also including a bottom cover being removably disposed upon said open bottom of said housing;

a tubular mold support member being removably disposed in said housing and being adapted to removably receive a mold, said tubular mold support member having side walls and a plurality of fluted grooves disposed in an exterior of said side walls, said tubular mold support member being attached to said top cover, said fluted grooves having a depth not exceeding ⅓ thickness of said tubular mold support member;

a plurality of water blocker members being removably disposed in said housing and about said tubular mold support member, each of said water blocker members being an elongate block being disposed about a respective corner of said tubular mold support member and having longitudinal flanges extending outwardly from side walls and near a corner of said elongate block, said longitudinal flanges being spaced apart with a respective said corner of said tubular mold support member being received therebetween to effectuate heat transfer from a mold being disposed in said tubular mold support member;

a restriction-free water flow assembly including a plurality of restriction-free water flow members being removably disposed in said housing and about said tubular mold support member, each of said restriction-free water flow members being an elongate tubular member which has a top meniscus and a bottom meniscus and which is disposed upon a respective said side wall of said tubular mold support member, said restriction-free water flow assembly including a plurality of top cap swedges being disposed upon said top meniscuses and also including a plurality of bottom cap swedges being disposed upon said bottom meniscuses; and a water flow control assembly being mounted to said support base assembly, said water control assembly including a plurality of inlet and outlet hose members being attached to said inlet and outlet holes respectively, and also including a plurality of valve members being disposed inline of said outlet hose members, and further including a plurality of thermocouples being attached to said outlet hose members, and also including a computer link member being attached to said support base assembly and to said valve members and to said thermocouples, said computer link member being adapted to be connected to a computer for controlling operation of said valve members and said thermocouples to effect flow of water through said hose members, said inlet hose members being adapted to be connected to a water source.

* * * * *